US005641937A

United States Patent [19]

Carter

[11] Patent Number: 5,641,937

[45] Date of Patent: Jun. 24, 1997

[54] BULLET

[75] Inventor: Herman L. Carter, Houston, Tex.

[73] Assignee: Trophy Bonded Bullets, Inc., Houston, Tex.

[21] Appl. No.: 673,912

[22] Filed: Jul. 1, 1996

Related U.S. Application Data

[62] Division of Ser. No. 531,118, Sep. 20, 1995.

[51] Int. Cl.[6] ..... F42B 12/34

[52] U.S. Cl. ..... 102/507; 102/514; 29/1.22

[58] Field of Search ..... 102/501, 507–510, 102/514–517; 29/1.2, 1.22, 1.23

[56] References Cited

U.S. PATENT DOCUMENTS

| | | | |
|---|---|---|---|
| 2,333,091 | 11/1943 | Crasnoff | 102/507 |
| 2,838,000 | 6/1958 | Schreiber | 102/507 |
| 3,003,420 | 10/1961 | Nosler | 102/508 |
| 3,143,966 | 8/1964 | Burns, Jr. et al. | 102/507 |
| 4,044,685 | 8/1977 | Avcin | 102/91 |
| 4,517,898 | 5/1985 | Davis et al. | 102/514 |
| 4,793,037 | 12/1988 | Carter | 102/507 |
| 4,879,953 | 11/1989 | Carter | 102/507 |
| 5,259,320 | 11/1993 | Brooks | 102/509 |
| 5,333,552 | 8/1994 | Corzine et al. | 102/509 |
| 5,404,815 | 4/1995 | Reed | 102/507 |

OTHER PUBLICATIONS

Hornady 1995 Catalog, pp. 34–35.

*Primary Examiner*—Harold J. Tudor
*Attorney, Agent, or Firm*—Vaden, Eickenroht, & Thompson, L.L.P.

[57] ABSTRACT

A soft nose, bonded lead core bullet for rifles and pistols and a method of making the bullets is disclosed. The bullets have a Jacket of copper based material with a solid base portion and an upper nose portion having a cavity in which the lead core is located and bonded to the walls of the cavity. The walls of the cavity decrease in width away from the base and curves inwardly to form an ogive shape. The jacket increases in hardness and strength from the upper end of the cylindrical wall to the base of the bullet. The cylindrical wall has an outer lip between 0.012 and 0.020 inches wide and the ratio of the lip thickness to the bottom cavity wall thickness is about 0.18–0.20 for rifle bullets and about 0.3–0.4 for pistol bullets.

8 Claims, 2 Drawing Sheets

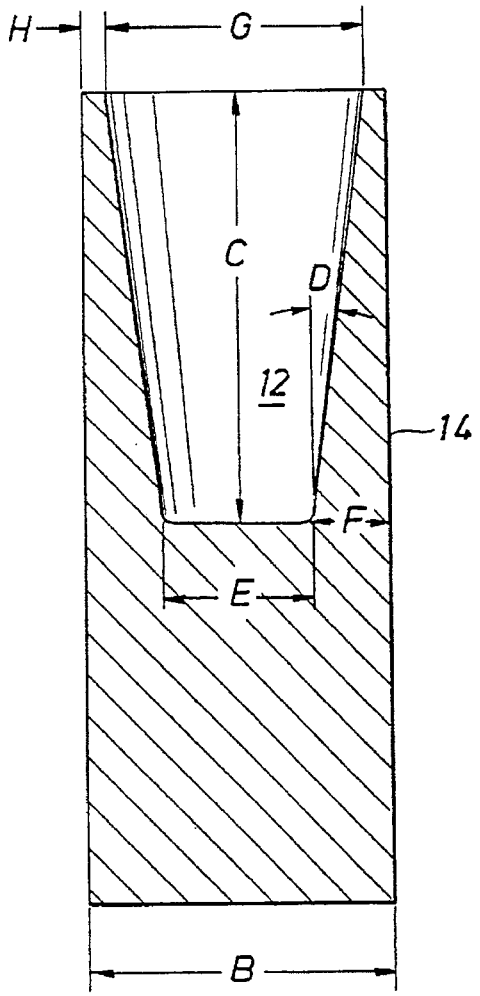
FIG. 1
FIG. 2
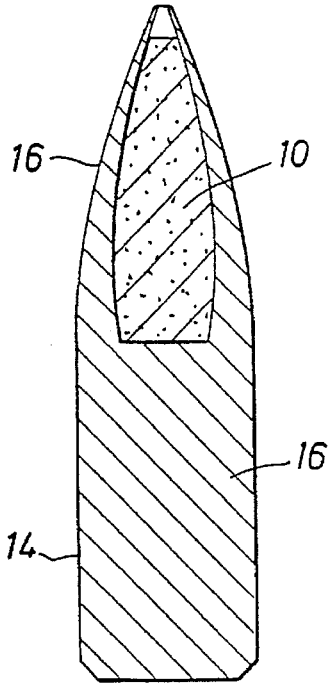
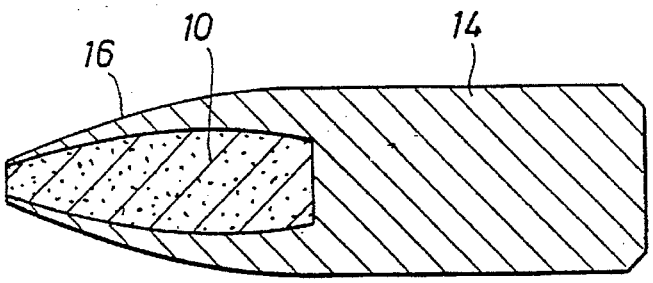
FIG. 3
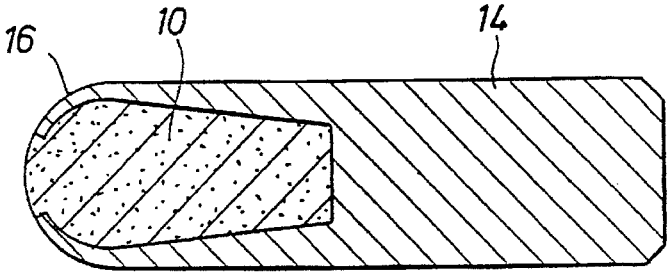
FIG. 4

BULLET

This invention, which is a divisional of patent application Ser. No. 08/531,118, filed Sep. 20, 1995 for "BULLET", relates to bullets generally and, in particular, to bullets of the bonded core, soft nose, controlled expansion type for hunting, self-defense, and law-enforcement purposes.

This invention is an improvement on the bullet described in U.S. Pat. No. 4,879,953. The method of making the bullet of this invention and the bullet described in the '953 patent is described in U.S. Pat. No. 4,793,037. Specifically, these bullets are made by placing lead in a cavity in a Jacket of copper base material, heating the Jacket to bond the lead to the walls of the cavity, annealing the jacket to increase its ductility and reduce its hardness, drawing the Jacket to a smaller diameter to increase the tensile strength and hardness of the base portion.

The cavity shown in the '953 patent included an upper hollow section having converging tapered walls, a lower cylindrical section of smaller diameter and a transition section connecting the upper and lower sections. Thus, the width of the wall of the cavity increased gradually from the outer end toward the transition zone where the walls increased in width substantially. The upper section was designed to split longitudinally into four or five sections that would peel backwardly and outwardly when the bullet impacts its target, thereby expanding the diameter of the bullet and its effectiveness.

Although this was the intended result and the bullets manufactured in accordance with the '953 patent are superior to any other bullet now on the market, better consistency in the amount of expansion would improve the performance of the bullet and it is an object of this invention to provide such a bullet having a more predictable expansion.

It is an object of this invention to provide a controlled expansion bullet that consistently retains 90% or more of its original weight and consistently expands to a desired frontal diameter that is generally 1.6 to 1.8 times larger than the bullet's original diameter for rifle bullets and 1.4 to 1.5 times larger than the bullet's original diameter for pistol bullets.

This ratio of bullet weight retention and frontal expansion represents the optimum level for both energy transfer and depth of penetration. A bullet with too much expansion decreases the depth of penetration and the period of energy transfer. A bullet with too little expansion reduces energy transfer.

It is another object of this invention to provide a method of making a bullet with a copper alloy Jacket that consists of a solid shank base section and a frontal tapered expansion cavity that will contain a bonded lead core.

It is a further object of this invention to provide pistol bullets having calibers ranging from 0.355 inches to 0.450 inches that have cavities, in which the lead core is bonded that are similar in shape for all pistol bullets, said cavities comprising truncated cones with side walls tapered between 1.5 to 2.4 degrees and outer lips between 0.012 and 0.015 inches thick.

Dependent upon bullet caliber, the Jacket cavities for pistol bullets in calibers from 0.355 to 0.450 will utilize the following design characteristics:

The cavity bottom hole diameter ranges from about 0.300 inches to 0.366 inches. The top of the cavity hole diameter can range from about 0.326 inches to 0.422 inches. The Jacket wall thickness at the bottom or base of the cavity hole can range from about 0.060 inches to about 0.090 inches. The thickness of the cavity lip can range from about 0.012 to about 0.015 inches. The depth of the cavity can range from 0.470 to 0.566 inches.

Another object of this invention is to provide a method of making different weight rifle bullets of the same caliber by using identical Jacket cavities and increasing or decreasing the length of the solid copper base section to provide the desired weight of the finished bullet.

The thin front lip of the cavity provides for expansion at relatively low impact velocities, and the heavy wall thickness at the base of cavity provides the necessary strength to reduce the over expansion of the expanded bullet at high impact velocities.

It is a further object of this invention to provide a method of making soft nose, bonded core rifle and pistol bullets that have an outer jacket that increases in hardness, and therefore tensile strength, from the soft nose rearwardly toward the base of the bullet. This results in reducing over expansion at high velocities.

It is a further object of this invention to provide such bullets and a method of making the same that includes forming a generally cylindrically-shaped solid base Jacket out of copper base material with a truncated conical cavity having an outer lip between 0.012 and 0.020 inches wide and the ratio of width of the lip to the bottom cavity wall thickness being between 0.18 and 0.20, placing a predetermined amount of lead in the jacket, heating the Jacket to a temperature sufficient to melt the lead and cause it to bond to the inner surface of the jacket and at the same time annealing the entire Jacket to remove any stresses created in the jacket during the forming of the jacket, drawing the base of the Jacket to a diameter less than the desired caliber to both harden the base material and to increase its tensile strength, placing the drawn jacket with the bonded core material in a die, and forming the bullet to the desired shape at the same time expanding the base of the jacket to the desired caliber thereby adding further work hardening to the material of the base while forming the nose of the bullet to the desired ogive design.

The base and walls of pistol bullet Jackets are of generally uniform thickness and relatively thin and, therefore, will deform if subjected to high chamber pressures. Base deformation of the bullet while in the barrel destroys accuracy. Consequently, pistol bullet cartridges are loaded to produce chamber pressures that will not deform the jacket of the bullets, which limits the muzzle velocity of pistol bullets.

It is an object and feature of this invention to provide pistol bullets having a base that will not deform under high chamber pressure thereby allowing substantial increase in the muzzle velocity of pistol bullets, which increases accuracy and impact on the target.

It is a further object and feature of this invention to provide a pistol bullet having an outer Jacket of copper base material having a cavity with outwardly diverging walls to provide a lip between 0.012 and 0.015 inches thick and a base having a thickness twice as thick as the bottom wall to provide sufficient strength to the base to not deform under high chamber pressures.

These and other objects, advantages, and features of this invention will be obvious to those skilled in the art from a consideration of this specification including the attached drawings and appended claims.

IN THE DRAWINGS

FIG. 1 is a cross-sectional view of the rifle bullet of this invention showing the shape of the cavity that provides the controlled expansion of the bullet. The important dimensions of the cavity and the jacket of the bullet shown in FIG. 1 are given letter designations to which values are assigned in Schedule A below for various calibers of rifle bullets.

FIGS. 2, 3, 4, and 5 are varying shapes of bullets that can be formed from the jacket shown in FIG. 1. FIG. 2 is called a spitzer shape. FIG. 3 is called a protected point bullet, and FIG. 4 is a round nose bullet. FIG. 5 is a spitzer with a plastic point. All these shapes are formed from the jacket shown in FIG. 1.

Figure 5:
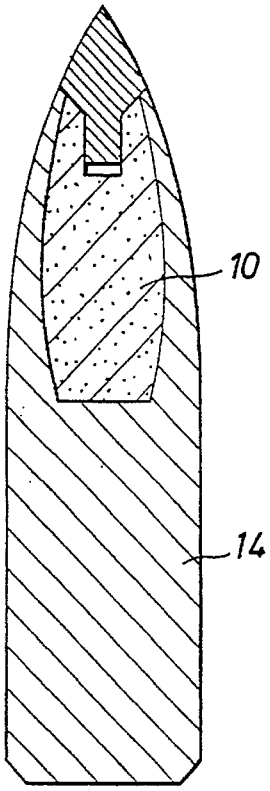
Figure 6:
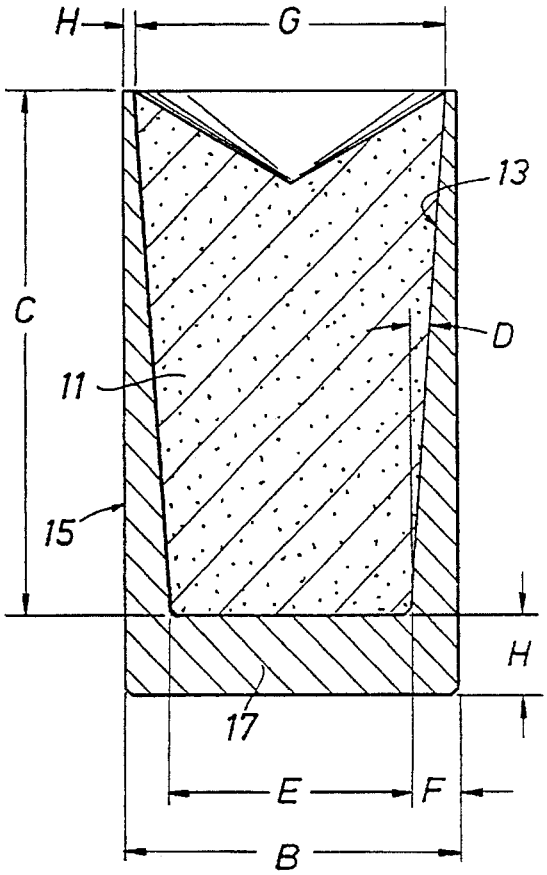
FIG. 6 is a cross-sectional view of the pistol bullet of this invention showing the shape of the cavity formed in the Jacket in which the lead is placed and bonded to the walls of the cavity. As in FIG. 1, the important dimensions of the cavity and the Jacket are given letter designations to which values are assigned in Schedule B below for various calibers of pistol bullets.

The dimensions set out below in Schedule A Rifle Bullet Design and Schedule B Pistol Bullet Design set out below have been determined to provide the consistent controlled expansion ratios shown in Schedules A2 and B2.

SCHEDULE A2 - RIFLE BULLETS EXPANSION RATIO

| BULLET DIAMETER | TIMES DIAM. EXP. RATIO | EXPANDED DIAM. | EXPANDED SQ. INCHES |
|---|---|---|---|
| .224 | 1.8 | .403 | .128 |
| .243 | 1.8 | .437 | .150 |
| .257 | 1.8 | .463 | .168 |
| .264 | 1.8 | .475 | .177 |
| .277 | 1.8 | .499 | .195 |
| .284 | 1.8 | .511 | .205 |
| .308 | 1.7 | .524 | .215 |
| .338 | 1.7 | .575 | .259 |
| .358 | 1.7 | .609 | .291 |
| .375 | 1.6 | .600 | .283 |
| .416 | 1.6 | .660 | .348 |
| .458 | 1.6 | .733 | .422 |

SCHEDULE A - RIFLE BULLET DESIGN

| BULLET DIA. | JACKET DIA. | CAVITY DEPTH | DRAFT ANGLE DEGREE | CAVITY BOTTOM DIA. | WALL THICKN | CAVITY TOP DIA. | CAVITY LIP THICKN | RATIO G TO E | RATIO H TO F | RATIO B TO F |
|---|---|---|---|---|---|---|---|---|---|---|
| A | B | C | D | E | F | G | H | I | J | K |
| .224 | .229 | .470 | 6.15' | .100 | .064 | .203 | .013 | 2.03 | .20 | 3.58 |
| .243 | .248 | .528 | 6. | .109 | .069 | .220 | .014 | 2.02 | .20 | 3.59 |
| .257 | .262 | .541 | 6.10' | .117 | .072 | .234 | .014 | 2.00 | .19 | 3.64 |
| .264 | .269 | .555 | 6.4' | .123 | .073 | .241 | .014 | 1.96 | .19 | 3.68 |
| .277 | .282 | .560 | 6.10' | .132 | .076 | .254 | .014 | 1.95 | .18 | 3.71 |
| .284 | .289 | .562 | 6.20' | .134 | .078 | .259 | .015 | 1.93 | .19 | 3.71 |
| .308 | .313 | .570 | 6.45' | .148 | .084 | .283 | .015 | 1.91 | .18 | 3.73 |
| .338 | .343 | .576 | 7.15' | .166 | .087 | .311 | .016 | 1.87 | .18 | 3.94 |
| .358 | .363 | .567 | 7.20' | .185 | .089 | .331 | .016 | 1.79 | .18 | 4.08 |
| .366 | .371 | .567 | 7.20' | .190 | .090 | .339 | .016 | 1.78 | .18 | 4.12 |
| .375 | .380 | .562 | 7.30' | .200 | .090 | .348 | .016 | 1.74 | .18 | 4.22 |
| .416 | .421 | .569 | 7.45' | .240 | .090 | .389 | .018 | 1.62 | .20 | 4.68 |
| .458 | .463 | .569 | 7.45' | .268 | .098 | .423 | .020 | 1.58 | .20 | 4.72 |
| .474 | .479 | .566 | 7.50' | .283 | .098 | .439 | .020 | 1.55 | .20 | 4.89 |

SCHEDULE B - PISTOL BULLET DESIGN

| BULLET DIA. A | JACKET DIA. B | CAVITY DEPTH C | DRAFT ANGLE DEGREE D | CAVITY BOTTOM DIA. E | WALL THICKN F | CAVITY TOP DIA. G | CAVITY LIP THICKN H | BASE THICKN I | RATIO G TO E J | RATIO H TO F K | RATIO B TO F L | RATIO I TO F M |
|---|---|---|---|---|---|---|---|---|---|---|---|---|
| .355 | .360 | .475 | 1.58' | .300 | .030 | .326 | .012 | .060 | 1.09 | 0.40 | 12.06 | 2.00 |
| .355 | .360 | .518 | 1.58' | .300 | .030 | .326 | .012 | .060 | 1.09 | 0.40 | 12.06 | 2.00 |
| .357 | .362 | .575 | 1.48' | .302 | .030 | .328 | .012 | .060 | 1.09 | 0.40 | 12.06 | 2.00 |
| .357 | .362 | .600 | 2.52' | .272 | .045 | .332 | .015 | .090 | 1.22 | 0.33 | 8.04 | 2.00 |
| .400 | .405 | .605 | 2.39' | .325 | .045 | .381 | .015 | .090 | 1.17 | 0.33 | 9.00 | 2.00 |
| .430 | .435 | .610 | 2.38' | .345 | .045 | .401 | .015 | .090 | 1.16 | 0.33 | 9.66 | 2.00 |
| .450 | .456 | .620 | 2.35' | .366 | .045 | .422 | .015 | .090 | 1.15 | 0.33 | 10.13 | 2.00 |

SCHEDULE B2 - PISTOL BULLETS EXPANSION RATIO

| BULLET DIAMETER | TIMES DIAM. EXP. RATIO | EXPANDED DIAM. | EXPANDED SQ. INCHES |
|---|---|---|---|
| .355 | 1.5 | .532 | .223 |
| .357 | 1.5 | .535 | .225 |
| .400 | 1.4 | .560 | .246 |
| .430 | 1.4 | .602 | .285 |
| .450 | 1.4 | .630 | .311 |

Key dimensions in Schedules A and B are dimension F, the Wall Thickness, which is the wall thickness measured at the bottom of the cavity, Lip Thickness H, and the ratio of H to F in Column J. The width of the wall of the cavity increases at a uniform rate toward the bottom of the cavity. By holding the ratio of H to F around 18% to 20% for the rifle bullets and the width of the lip between 0.013 and 0.020 inches, the expansion of any bullet in Schedule A will be between about 1.6 to about 1.8 times the diameter of the bullet. Also, by holding the ratio of H to F around 33% to 40% for pistol bullets and the width of the lip between 0.012 and 0.015 inches, the expansion of any bullet in Schedule B will be about 1.4–1.5 times the diameter of the bullet. The other dimensions will vary depending upon the diameter of the bullet.

Figure 7:
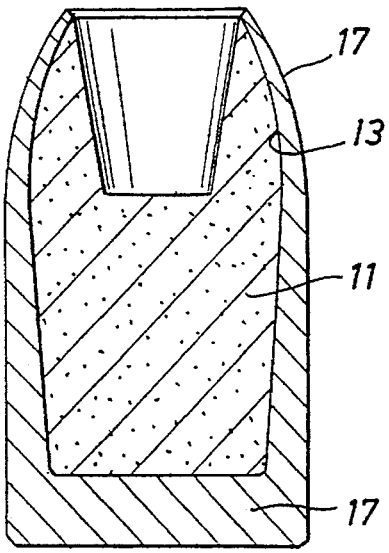
FIG. 7 is a cross-sectional view of a hollow point pistol bullet formed from the Jacket and lead filled cavity of FIG. 6.
Figure 8:
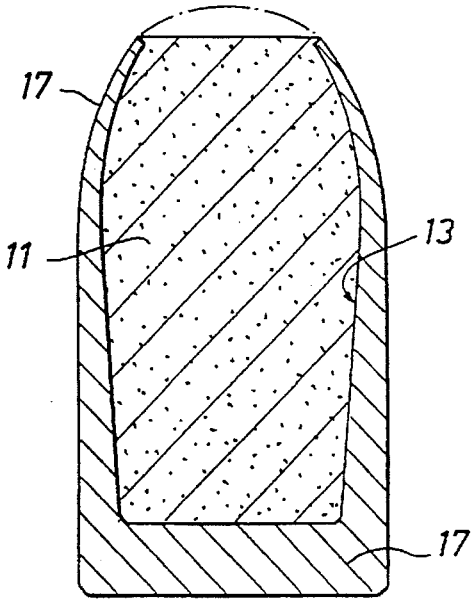
FIG. 8 is a cross-sectional view of a flat nose pistol bullet, and in dashed lines a round nose bullet, both of which can be formed from the Jacket and lead filled cavity of FIG. 6 although the amount of lead may differ somewhat.

To make the rifle bullets shown in FIGS. 2, 3, 4, and 5 and the pistol bullets shown in FIGS. 7 and 8, an appropriate amount of lead, indicated by the No. 10 and 11 is placed in cavities 12 and 13 of preformed jackets 14 and 15. The cavities are designed in accordance with Schedules A and B for a given caliber of bullet. The Jackets and the lead are then heated to a temperature sufficient to melt the lead and cause it to bond to the inner surface of the cavities in the jackets. This also anneals the jackets and removes any stresses created in the jackets while they were being formed. Next the outer diameter of each jacket is drawn slightly smaller than the bullet diameters shown in Column A of the schedules for the particular caliber of bullets being manufactured. This step work hardens the metal in base portions 16 and 17 of the bullets. It also work hardens the metal in the walls of cavities 12 and 13 but to a lesser extent because of the smaller amount of metal involved. The last step in the manufacture of the bullet of this invention is to place the bullet in a forming die and force the walls of cavities 12 into the particular ogived shape shown in FIGS. 2, 3, 4, and 5 for the rifle bullets and FIGS. 7 and 8 for the pistol bullets. In the same operation, the outer diameter of the jackets will be expanded to the desired caliber of the bullets being manufactured. The bullet diameter for each caliber is shown in Column A of Schedules A and B. This further work hardens and strengthens these portions of the jacket. Nose portions 16 and 17 of each bullet will also be work hardened to some extent as its outer walls are forced into one of the shapes shown in the drawings. This work hardening will be very slight compared to the work hardening that occurs in the base.

From the foregoing it will be seen that this invention is one well adapted to attain all of the ends and objects hereinabove set forth, together with other advantages which are obvious and which are inherent to the method and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A pistol bullet comprising an outer jacket of copper based material, said jacket including a solid base portion and a nose portion, said nose portion having a cylindrical wall that decreases in thickness away from the base portion and curves inwardly to form a cavity, said Wall having an inner surface, an outer surface, and an upper end, and a body of lead in the cavity that is bonded to the inner surface of the Wall of the cavity, said cylindrical wall having an outer lip of uniform thickness, with the wall at the lip of the cavity having a thickness between 0.012 and 0.015 inches and the ratio of the thickness of the lip to the thickness of the wall at the base being between 0.33–0.40 and the thickness of the base being about two times the thickness of the cavity wall at the base to provide a pistol bullet that will withstand high chamber pressures without deformation.

2. The bullet of claim 1 in which the base portion is drawn to a diameter less than its finished diameter to increase the hardness and tensile strength of the base portion above the hardness and tensile strength of the nose portion and thereafter expanded to its finished diameter to further increase its hardness and tensile strength.

3. The pistol bullet of claim 1 or 2 in which the ratio of the diameter of the cavity at the lip to the diameter of the cavity at the bottom ranges from about 1.09 to 1.22.

4. A pistol bullet comprising an outer jacket of copper based material and an inner core of lead bonded to the jacket, said jacket including a base portion and a nose portion, said nose portion having a cylindrical wall that decreases in thickness away from the base portion and curves inwardly to form a cavity, said wall having an inner surface, an outer surface, an upper end, and a body of lead in the cavity that is bonded to the inner wall, said cylindrical wall having an outer lip of uniform thickness, with the wall at the lip of the cavity having a thickness between 0.012 and 0.015 inches, the ratio of the thickness of the lip to the thickness of the wall at the base being between 0.33 and 0.40, and the thickness of the base being between about 0.060 inches to 0.090 inches.

5. The bullet of claim 4 in which the copper based material of the jacket increases in hardness and tensile strength from the nose portion to the base portion so that the base portion will remain intact after impact with a target while at least a portion of the nose portion splits longitudinally and expands to a diameter between 1.4 and 1.5 times the diameter of the bullet as the bullet travels into the target with a minimum in weight reduction.

6. The bullet of claim 4 or 5 in which the base portion is drawn to a diameter less than its finished diameter to increase the hardness and tensile strength of the base portion above the hardness and tensile strength of the nose portion and thereafter expanded to its finished diameter to further increase its hardness and tensile strength.

7. A soft nose, bonded lead core bullet for pistols comprising a jacket of copper based material having a solid base portion and a nose portion having a cylindrical wall extending from the base that decreases in thickness away from the base and curves inwardly to form a cavity, said Wall having an inner surface, an outer surface, an upper end, and a body of lead in the cavity bonded to the inner surface of the wall of the cavity, said jacket increasing in hardness and strength from the upper end of the cylindrical wall to the base of the bullet, said cylindrical wall having an outer lip of uniform thickness between 0.012 and 0.015 inches and the ratio of the lip thickness to the bottom cavity wall thickness being between 0.33–0.40.

8. The bullet of claim 7 in which the pistol bullet expands between 1.4 and 1.5 times its diameter upon impact.

* * * * *